US005974945A

United States Patent [19]

Gooch

[11] Patent Number: 5,974,945

[45] Date of Patent: Nov. 2, 1999

[54] PNEUMATIC VALVE POSITIONER WITH ADJUSTABLE GAIN

[75] Inventor: Robert Gooch, Orem, Utah

[73] Assignee: Valtek, Inc., Springville, Utah

[21] Appl. No.: 08/911,342

[22] Filed: Aug. 14, 1997

[51] Int. Cl.[6] ..... F15B 9/08

[52] U.S. Cl. ..... 91/386; 91/387; 137/85

[58] Field of Search ..... 91/386, 387; 137/85

[56] References Cited

U.S. PATENT DOCUMENTS 3,915,062 10/1975 Westfall et al. ..... 91/386 X
5,251,148 10/1993 Haines et al. .

OTHER PUBLICATIONS

Valtek brochure, "System 80 Pneumatic Positioner", 1993.
Valtek brochure, "Summary of Operations", 1993.

*Primary Examiner*—Gerald A. Michalsky

*Attorney, Agent, or Firm*—Killworth, Gottman, Hagan & Schaeff, LLP

[57] ABSTRACT

A feedback control system (i.e., a positioner) for precise positioning of a pneumatic actuator by adjusting the flow of air to the pneumatic actuator comprises an adjustable gain mechanism for adjusting the sensitivity of the positioner. The adjustable gain mechanism is coupled between a feedback input device of the positioner and a valve control device and is employed to adjust the amount of air supplied to the pneumatic actuator for a given displacement of the feedback input device. Preferably the adjustable gain mechanism is adjustable through a range of settings between a high gain setting and a low gain setting, the high gain setting allowing a greater range of motion of the valve control device than the low gain setting for a given displacement of the feedback input device.

20 Claims, 3 Drawing Sheets

PNEUMATIC VALVE POSITIONER WITH ADJUSTABLE GAIN

BACKGROUND

1. Field of the Invention

This invention relates generally to a feedback control system for precise positioning of pneumatic actuators and, more specifically, to a pneumatic positioner used in conjunction with a pneumatic actuator providing precise positioning of the pneumatic actuator by adjusting the flow of air to the pneumatic actuator and having an adjustable gain mechanism for adjusting the sensitivity of the positioner.

2. Background of the Invention

Valtek International, the assignee of the present invention, is a manufacturer of automatic control valves, actuators, intelligent systems, and associated equipment to the chemical, petrochemical, power, pulp and paper, petroleum, and associated process industries. Facilities of these industries utilize control valves to regulate the flow, pressure, or temperature of liquids and gases in various process systems. Control valves are a special type of valve having a power positioning actuator which is responsive to externally supplied signals for operating (i.e., moving) a throttling or closure mechanism located in the valve body. Typical valves include rotary valves (e.g., ball, plug, and eccentric disk) and linear valves (e.g., globe and gate). An exemplary globe-type control valve includes a valve body having an internal passage formed therein with an inlet opening for receiving fluid, an outlet opening for discharging fluid, and a central opening located in the valve body between the inlet opening and outlet opening and forming a valve seat therein. A valve stem, with a valve plug located on one end thereof, is disposed to extend into the valve body and is movable to selectively move the plug onto and off from the valve seat to thereby close the central opening and stop the flow of fluid, or unclose the central opening and allow the flow of fluid, respectively. The other end of the valve stem, opposite that on which the plug is located, is coupled to an actuator typically mounted on top of the valve body. The actuator includes a cylinder, and a moveable piston disposed in the cylinder and coupled to the other end of the valve stem (or could include a diaphragm for operating the stem. A pressurized source of air is supplied to a feedback control system (commonly referred to as a positioner and oftentimes located at the side of the actuator) to direct pressurized air to the cylinder both above and below the piston, in response to control signals, to thereby cause the piston to move to selected positions in the cylinder and thus the plug to move to open the valve a desired amount. By controlling the position of the plug in the valve body, upstream pressure, downstream pressure, and temperature of the fluid flowing through the valve (as well as external variables such as pressure or volume of fluids in tanks connected to the system, pH of fluid in the system, etc.) can be controlled.

While the concept of using the flow of air into a cylinder to position a piston therein may be a simple concept, the regulation of the air flow to achieve precise positioning of the piston within the cylinder requires such a feedback control system. A pneumatic positioner is employed to ensure that the piston is at a desired position within the cylinder and that the piston maintains this position until a change in the position of the valve stem is desired. Thus, the pneumatic positioner provides the appropriate flow of air into the actuator and regulates the air and pressure based on the desired position of the piston and feedback from the piston to the pneumatic positioner.

Feedback of the piston to the pneumatic positioner is generally accomplished by providing a feedback device (e.g., a spring) having one end in communication with the piston (e.g., through a linkage mechanism) and the other end in communication with the pneumatic positioner (e.g., attached to a diaphragm assembly or input capsule of the pneumatic positioner). Tension of the feedback device provides feedback to the positioner, which will vary as the valve stem position changes. Thus, when a feedback spring is employed, the spring-loaded force is applied through feedback linkage and a cam assembly to the input capsule. An instrument signal (i.e. air pressure) is applied between diaphragms of the input capsule which forces the input capsule in a direction that stretches the feedback spring. Movement of the input capsule away from the feedback spring also causes the pneumatic positioner to increase the flow of air into the actuator in order to retract the piston and thus the valve stem into the cylinder. Movement of the valve stem in turn cause the linkage between the valve stem and the feedback spring to apply force to the feedback spring and thus stretch the spring away from the input capsule. When the opposing forces between the input capsule and the feedback spring balance exactly, the system will be in equilibrium and the valve stem will be in the position called for by the instrument signal. If the opposing forces are not in balance, the input capsule will move up or down and the positioner will change the output pressures of the air supply lines, moving the valve stem until the tension on the feedback spring opposes exactly the instrument signal pressure. Thus, air will continue to be supplied into the actuator until the piston and valve stem are retracted a sufficient amount to create a balance between input capsule and the feedback spring.

In order to adjust the flow of air into the actuator, displacement of the input capsule moves an elongate member (hereinafter referred to as the flapper) connected on one end to the input capsule and attached at the other end to another diaphragm assembly (hereinafter referred to as the pilot valve capsule). Displacement of the flapper moves the flapper away from a detection nozzle, which in turn causes movement in the pilot valve capsule. Movement of the pilot valve capsule opens one or more valves and allows a flow of air into the cylinder of the actuator in order to move the piston housed therein. In the prior art positioner, the flapper is secured to the input capsule with an attachment spring. The attachment spring is secured relative to the input capsule and flapper at two positions corresponding to two gain settings, low and high. The low gain setting is achieved by attaching the flapper to the input capsule at the point farther from the detection nozzle. Typically, a low gain setting (i.e., 300 to 1) is a standard setting for a size 25 linear actuator and a high gain setting (i.e., 550 to 1) is standard for a size 50 linear actuator. In order to change the gain setting, the pneumatic positioner must be partially disassembled in order to remove and relocate the attachment spring and subsequently reassembled with the attachment spring secured between the flapper and input capsule at the gain setting. In addition, the gain can only be set at the high gain setting or the low gain setting with no intermediate settings possible.

Thus, it would be advantageous to provide a pneumatic positioner in which the gain can be adjusted without requiring disassembly of the pneumatic positioner. In addition, it would be advantageous to provide a pneumatic positioner in which the gain can be adjusted over a range of gain settings from a low gain setting to a high gain setting.

SUMMARY OF THE INVENTION

It is an object of the present invention to provide a pneumatic positioner having an adjustable gain mechanism in which adjustment of the gain does not require disassembly of the pneumatic positioner.

It is a further object of the present invention to provide a pneumatic positioner having an adjustable gain mechanism in which the gain is adjustable over a range of gain settings.

It is still a further object of the present invention to provide a pneumatic positioner having an adjustable gain mechanism in which the gain is infinitely adjustable between a high setting and a low setting.

In accordance with the aforementioned and other objects of the present invention, a pneumatic positioner is provided with an apparatus for adjusting the gain of the pneumatic positioner without the need to disassemble the pneumatic positioner and may be adjusted to a plurality of position between a high setting and a low setting. Preferably, the pneumatic positioner is coupled to a stem of a pneumatic actuator and includes an input sensing means for sensing the position of the stem and for receiving an input signal indicative of a desired position of the stem and a valve actuating means for selectively supplying air to the pneumatic actuator. The coupling means is coupled between the input sensing means and the valve actuating means so that displacement of the input sensing means results in displacement of the valve actuating means. In addition, the coupling means is securable relative to the input sensing means at a plurality of positions between a high gain setting and a low gain setting.

Preferably the positioner is comprised of a body defining a plurality of air passageways including a main air supply passageway, a first cylinder supply passageway, a second cylinder supply passageway, an instrument signal passageway, and a detection passageway. An input capsule is coupled to the body and is responsive to changes in air pressure provided by an instrument signal in the instrument signal passageway. A pilot valve capsule is also coupled to the body and is in communication with the main air supply passageway. As air flows through the detection passageway, the air pressure above the pilot valve capsule changes, resulting in displacement of the pilot valve capsule. The pilot valve capsule is coupled to a first valve assembly and a second valve assembly. Thus, displacement of the pilot valve capsule in one direction results in a flow of air in one direction through the first and second cylinder supply passageways, while displacement of the pilot valve capsule in the other direction results in a flow of air in the opposite direction through the first and second cylinder supply passageways. An elongate member or flapper is attached to the pilot valve capsule and extends at least partially over the input capsule. A portion of the elongate member is positioned adjacent a detection nozzle attached to an output of the detection passageway. Finally, a variably adjustable attachment member or attachment spring extends between the input capsule and the elongate member. Thus, displacement of the input capsule results in displacement of the elongate member. When the elongate member is moved away from the detection nozzle, the flow of air through the detection passageway is increased corresponding to a decrease in air pressure above the pilot valve capsule. The pilot valve capsule thus moves in the direction of the lower air pressure which opens valves in a way as to move the stem of the actuator until the elongate member again sufficiently restricts the flow of air through the detection nozzle to increase the air pressure in the detection passageway and move the pilot valve capsule back to a balanced position.

The attachment member is variably adjustable in order to provide various gain settings for the positioner depending on the position of the attachment member. Preferably, the adjustable gain mechanism comprises an elongate member or flapper having a first end configured for attachment to the pilot valve capsule. A first plate is associated with the input capsule and movable relative thereto. The attachment member has a distal end secured to the first plate and a proximal end securable relative to the elongate member. Thus, the attachment member can be positioned at any point between a first position (e.g., high gain setting) and a second position (e.g., low gain setting) to provide variable adjustment of the gain of the positioner. Once a gain setting has been selected, the first plate is secured to the input capsule and the attachment member is secured relative to the elongate member.

It is also contemplated that the adjustable gain mechanism further comprise a second plate movably associated with the elongate member and configured for being secured thereto. Thus the attachment member is secured to the second plate, and the second plate is secured to the elongate member when the attachment member is at the desired gain setting.

DETAILED DESCRIPTION OF THE PREFERRED EMBODIMENTS OF THE PRESENT INVENTION

Figure 1:
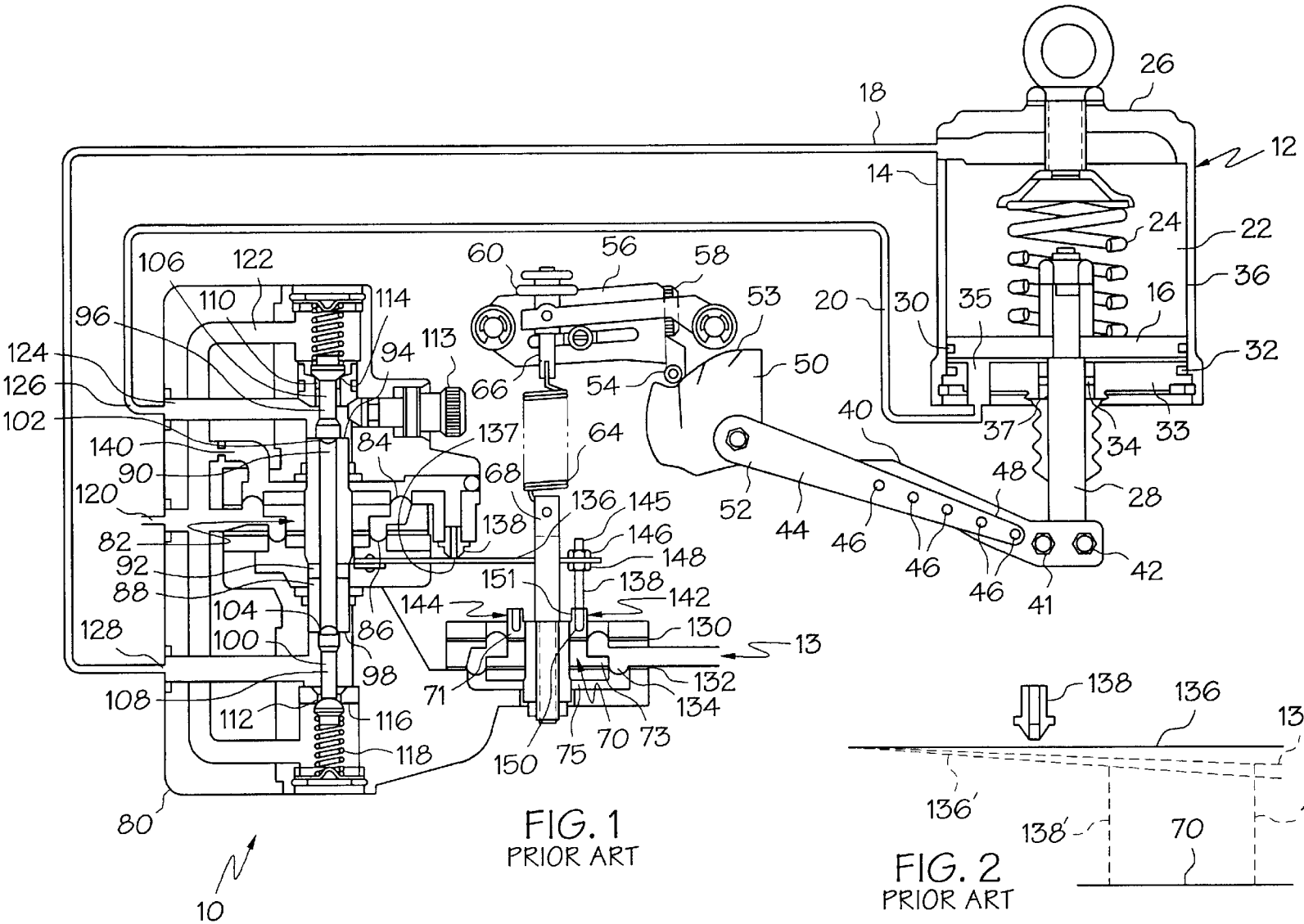
FIG. 1 PRIOR ART
FIG. 1 is a cross-sectional side view of a prior art positioner connected to a pneumatic actuator, the positioner including a gain mechanism that can be set at either a low gain setting, as shown, or a low gain setting.

FIG. 1 illustrates a prior art VALTEK pneumatic positioner 10 for controlling a pneumatic actuator 12 in which air is supplied to an instrument signal port 13 to the system in order to initiate retraction of the actuator 12. The pneumatic actuator 12 is comprised of a cylinder 14 having a piston 16 therein. A pair of supply lines 18 and 20 are secured to the actuator 12 and are in communication with the interior chamber 22 defined by the cylinder 14. Air is supplied above the piston 16 with supply line 18 and below the piston with supply line 20 to move the piston 16 within the cylinder 14 accordingly. A coil spring 24 is provided in the chamber 22 and in communication between the piston 16 and the distal end 26 of the actuator 12 in order to bias the piston 16 away from the distal end 26. A stem 28 is secured to the piston 16 and moves along with the piston 16 when actuated by the supply of air from supply lines 18 and 20. The proximal end 31 of the cylinder 14 is sealed with a substantially circular end member 33 that provides a port 35 for attachment of the air supply line 20 and an opening 37 for extension and retraction of the stem 28 therethrough as moved by the piston 16. A plurality of O-rings 30, 32, and 34 are provided to seal the piston 16 to the inside 36 of the cylinder 14, the end member 33 to the inside 36 of the cylinder 14, and the end member 33 to the stem 28, respectively.

In order to obtain feedback from the stem 28 as to its relative position, a take-off arm 40 is attached, as by bolts 41 and 42 to a portion of the stem 28 extending beyond the end member 33. A follower arm 44 is secured to the take-off arm 40 and is provided with a plurality of holes 46 along its proximal end 48 to provide various attachment points between the follower arm 44 and the take-off arm 40. A cam 50 is attached to the distal end 52 of the follower arm 44. The cam 50 is provided with a contoured surface 53 along an edge thereof, along which a cam roller bearing 54 can move. The cam roller bearing 54 is supported by a cam follower arm 56 which includes a range adjustment 58 for adjusting the position of the cam roller bearing 54 on the contoured surface 53 and a zero adjustment 60 for adjusting tension in a feedback spring 64. The feedback spring 64 is connected between a spring retaining member 66 attached to the cam follower arm 56 and an elongate input capsule member or feedback spring rod or holder 68, which is in turn secured to an input sensing device or input capsule 70 of the positioner 10.

The positioner, generally indicated at 10, is comprised of a body 80 that defines a plurality of internal passageways therein for directing a flow of air to the actuator 12. The positioner 10 comprises a pilot valve capsule 82 that is suspended between a pair of diaphragms 84 and 86 secured to the body 80. A hollow elongate member or relay tube 88 is secured to and extends through the pilot valve capsule 82 such that displacement of the pilot valve capsule 82 results in corresponding displacement of the relay tube 88. The relay tube 88 includes a longitudinally extending passageway 90 therethrough and a transversely extending passageway 92 in communication with the longitudinally extending passageway 90 and with the atmosphere. A first end 94 is in contact with a first valve actuating device 96 and a second end 98 is in contact with a second valve actuating device 100. The valve actuating devices 96 and 100 are comprised of exhaust seats 102 and 104, respectively, pilot poppets 106 and 108, respectively, and supply seats 110 and 112, respectively. Thus, displacement of the pilot valve capsule 82 in an upward direction upwardly moves the relay tube 88 forcing the pilot poppet 106 into the supply seat 110 and away from its associated seating surface 114 while the relay tube 88 maintains contact between the first end 94 and the exhaust seat 102. This same displacement of the pilot valve capsule 82 pulls the second end 98 of the relay tube 88 away from the exhaust seat 104 with the supply seat 112 being biased against its seating surface 116 with coiled spring 118. Air supplied through the supply port 120 consequently flows through the passageway 122, around the supply seat 110, out the port 126, and into the supply line 20. Air coming from the actuator 12 through supply line 18 enters the port 128, flows around the exhaust seat 104 and out the transversely extending passageway 92. As air is supplied through the supply line 20 to the actuator 12 and air is allowed to flow out of the cylinder 14 above the piston 16 through supply line 18, the piston 16 and thus the stem 28 moves in an upward direction toward the distal end 26. This flow of air will continue until the pilot valve 82 returns to a balanced or equilibrium position allowing both supply seats 110 and 112 to stop the flow of air into the actuator 12. The balance or equilibrium position can be adjusted, if necessary, with a balance adjustment mechanism 113 which moves the seating surface 114 relative to the body 80 and thus adjusts the position of the pilot valve capsule 82 and valve actuating devices 96 and 100 within the body 80. A decrease in instrument signal pressure reverses the described actions and causes a proportional downward movement of the actuator piston 16 and stem 28.

Displacement of the pilot valve capsule 82 is caused by movement or displacement of the input capsule 70. Similar to the pilot valve capsule 82, the input capsule 70 is comprised of first and second diaphragms 130 and 132 that support the input capsule 70 relative to the body 80 of the positioner 10 and three plates 71, 73, and 75 that form the body of the input capsule 70. The first and second diaphragms 130 and 132 and the three plates 71, 73, and 75 form an instrument signal chamber 134 thereinbetween in communication with the instrument signal port 13. The diaphragms 130 and 132 and input capsule 70 are arranged so that when air is supplied to the instrument signal port 13 and the pressure between the diaphragms 130 and 132 is increased, the input capsule 70 moves in a downward direction. Of course, the input capsule could be reconfigured for upward movement when the instrument signal pressure is increased.

Movement of the input capsule 70 has two direct effects. First, movement causes the feedback spring holder 68 to move and, second, movement causes an elongate member or flapper 136 to which the input capsule 70 is attached by a coupling device or attachment spring 138 to move. Downward movement of the feedback spring holder 68 in turn causes spring 64 to be stretched. Downward movement of the flapper 136, on the other hand, allows air to flow through a detection nozzle 138. In an equilibrium state, a portion 137 of the flapper 136 is in contact with or near the exit of the air detection nozzle 138 and restricts the flow of air therethrough. However, when air flows through the detection nozzle 138, air is allowed to flow from the passageway 122 into passageway or chamber 140 creating a low pressure zone above the pilot valve capsule 82. Air supplied between the diaphragms 84 and 86 forces the pilot valve capsule 82 into the chamber 140 resulting in movement of the valve actuating device 96, as previously described. Air is supplied to the actuator 12 and retracts the stem 28 to a point where the associated linkage stretches the feedback spring 64. The stem 28 will continue to retract until the spring 64 tension opposes exactly the force resulting from the instrument signal pressure. At this point, the input capsule 70 will move back to an equilibrium position and the flapper 136 will be moved toward the detecting nozzle 138 and restore the pressure above the pilot valve capsule 82 to its equilibrium value.

In this prior art illustration, the movement of the flapper 136 relative to the input capsule 70 is affected by an attachment spring 138 that is secured between the flapper 136 and the input capsule 70. The attachment spring 138 is secured between the input capsule 70 and the flapper 136 with first and second attachment devices such as a first externally threaded rod 145 attached to the flapper 136 with internally threaded nuts 146 and 148 and a second externally threaded rod 150 threaded into an internally threaded bore 151 in a top plate 71 secured atop the diaphragm 130 of the input capsule 70. The attachment spring 138 is threaded onto the threaded rods 145 and 150. As illustrated, the attachment spring 138 can be positioned at two points 142 and 144 relative to the flapper 136 and input capsule 70, corresponding to a low gain setting 142 and a high gain setting 144. While these two settings 142 and 144 are each standard for a respectively sized actuator, it is often the case that some intermediate gain setting is desired. However, with the prior art gain mechanism, adjustment at some point between a high gain setting and a low gain setting is not possible.

Figure 2:
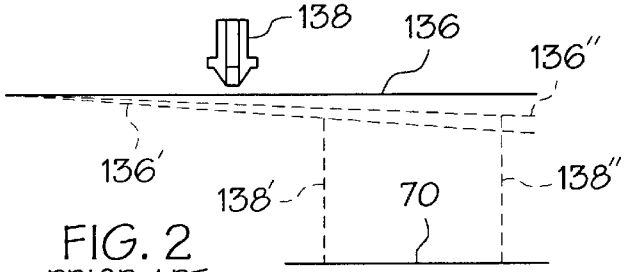
FIG. 2 PRIOR ART
FIG. 2 is a schematic representation comparing the amount of deflection of the flapper illustrated in FIG. 1 corresponding to a low gain setting and a high gain setting.

FIG. 2 schematically illustrates the flapper 136 in relation to the detection nozzle 138. A high gain setting of the attachment spring is represented by dashed line 138' and a low gain setting of the attachment spring is represented by dashed line 138". The input capsule to which the attachment spring is connected is represented by line 70. When the attachment spring as at the high gain setting 138', the flapper 136 will be deflected to position 136'. Likewise, when the attachment spring as at the low gain setting 138", the flapper 136 will be deflected to position 136". Of course, the relative amount of deflection has been exaggerated for illustration purposes. Thus, the high gain setting 138' provides greater deflection of the flapper 136 for the same relative deflection of the input capsule 70. As illustrated and described with reference to FIG. 1, deflection of the flapper 136 results in an increased flow of air through the detection nozzle 138 and changes the air pressure above the pilot valve capsule 82. By increasing the amount of deflection of the flapper 136 for some given deflection of the input capsule 70, the amount of air allowed to flow through the detection nozzle 138 will also increase, corresponding to an increase in sensitivity of the positioner. It may, however, be desirable to provide a gain setting at some intermediate point between the high gain setting 138' and the low gain setting 138" to accordingly adjust the sensitivity of the positioner and to keep the system stable.

Referring again to FIG. 1, in order to change the gain setting of the attachment spring 138, the feedback spring 64 must be removed and the cam follower arm 56 must be outwardly rotated. The nut 146 securing the threaded rod 145 to the flapper 136 must be removed. The body 80 of the positioner 10 must then be disassembled to move the flapper 136 away from the input capsule 70 without damaging the diaphragms 130 and 132 contained therein. In the prior art positioner 10 illustrated in FIG. 1, the gain setting cannot be adjusted without disassembling at least part of the positioner 10.

Figure 3:
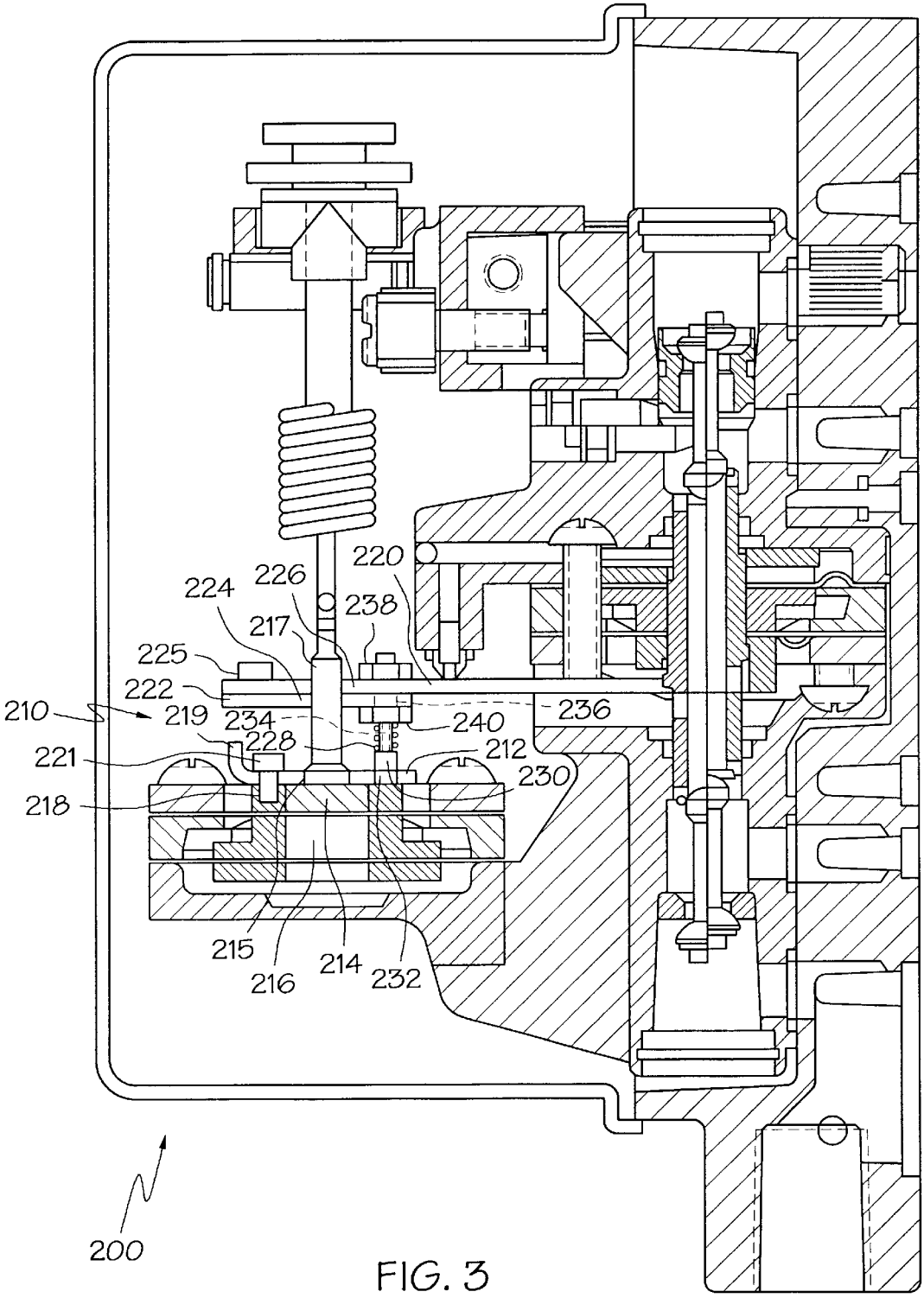
FIG. 3 is a cross-sectional side view of a positioner comprising a first preferred embodiment of a variably adjustable gain mechanism in accordance with the present invention.

FIG. 3 illustrates a positioner, generally indicated at 200, in accordance with the present invention. The positioner 200 is similar in construction to the positioner 10 illustrated in FIG. 1, but includes an adjustable gain mechanism, generally indicated at 210. The basic difference between the gain mechanism 210 and that illustrated in FIG. 1 is that the gain mechanism 210 is adjustable over a range of gain settings from a high setting to a low setting and can be adjusted without requiring disassembly of any part of the positioner 200.

The gain mechanism 210 is comprised of a first plate 212 attached to the top plate 214 of the input capsule 216 and includes a central opening 215 through which the feedback spring holder 217 extends. The first plate 212 is rotatable about the feedback spring holder 217 and includes a tab 219 extending therefrom for engagement by a user to rotate the first plate 212 relative to the feedback spring holder 217. An externally threaded fastener 221 attaches or secures the first plate 212 to the top plate 214 and is threaded into an internally threaded bore 218 in the top plate 214.

The gain mechanism 210 also includes a second plate 222 associated with a flapper 220 and defines a central opening 224 therein for extension of the feedback spring holder 217 therethrough. The flapper 220 also includes an opening 226 therethrough for passage of the feedback spring holder 217 and is preferably aligned with the opening 224 of the second plate 222. The alignment of the second plate 222 with the flapper 220 may be assisted by providing a flange around the upper edge of the opening 224 that fits within the opening 226 of the flapper 220. As with the first plate 212 to the top plate 214 of the input capsule 216, the second plate 222 is attached or secured to the flapper 220 with a threaded fastener 225 threadedly attached to the second plate 222.

The first plate 212 is connected to the second plate 222 by an attachment spring 228. A spring or other laterally flexible structure is preferred in order to allow deflection of the flapper relative to the input capsule 216 without causing the input capsule 216 to tilt to any substantial extent. A first externally threaded rod 230 is threaded into an internally threaded bore 232 in the first plate 212 and a second externally threaded rod 234 is retained within bore 236 in the second plate 222 with internally threaded nuts 238 and 240.

Figure 4:
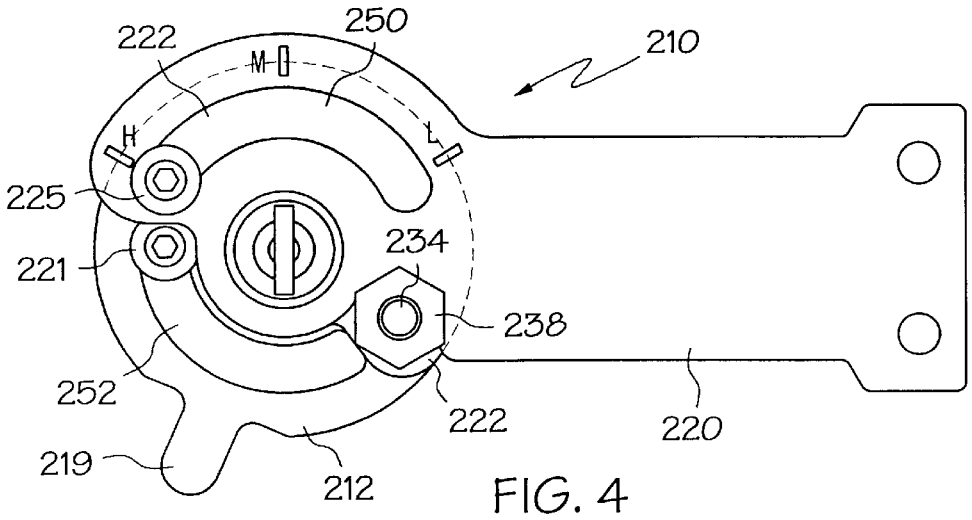
FIG. 4 is a top view of the variably adjustable gain mechanism illustrated in FIG. 3.

As better illustrated in FIG. 4, the flapper 220 defines a first arcuate slot 250 therein in which the threaded fastener 225 resides and fastens the second plate 222 to the flapper 220. The nut 238 fastens the rod 234 to the second plate 222. The externally threaded fastener 221 resides in a second arcuate slot 252 formed in the first plate 212. Accordingly, when fasteners 221 and 225 are loosened, rotational movement of the tab effects movement of the fastener 221 within the slot 252. This movement in turn caused movement of the second plate 222 as the first and second plates 212 and 222, respectively, are connected by the attachment spring 228 (see FIG. 3). Movement of the second plate 222 results in movement of the fastener 225 within the slot 250. When the fastener 225 is positioned as illustrated, the nut 238 and thus the attachment spring are in a high gain setting as indicated with an "H" proximate the fastener 225. When the fastener 225 is moved along the slot 250 proximate the positioned marked with an "L" the attachment spring is translated to a low gain setting. Of course, the fasteners 225 and 221 could be secured at any position along the slots 250 and 252, respectively to variably change the gain setting. Thus, the gain adjustment mechanism 210 of the present invention is adjustable to any setting in a range of gain settings between a high gain setting and a low gain setting.

Figure 5:
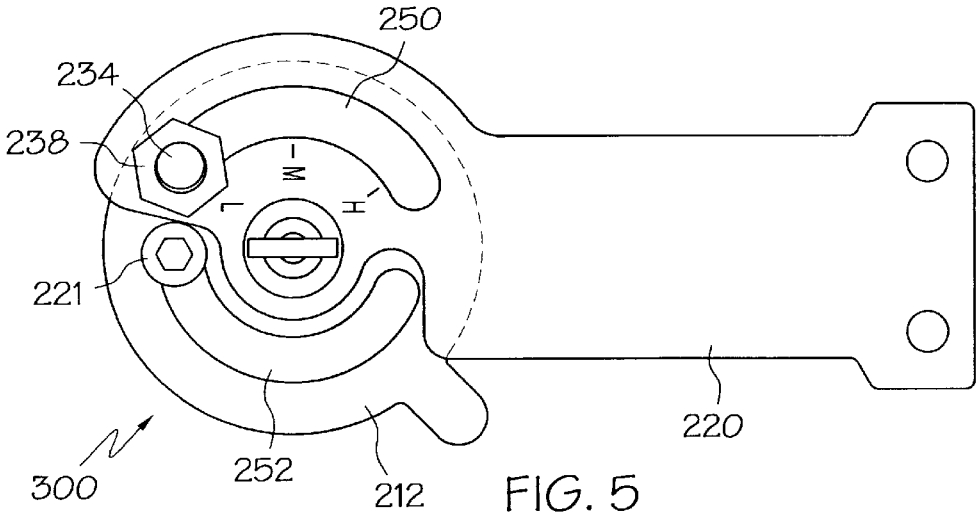
FIG. 5 is a top view of a second embodiment of a variably adjustable gain mechanism in accordance with the present invention.

FIG. 5 illustrates a similar adjustable gain mechanism 300 except that the nut 238 secures the rod 234 directly to the slot 250 of the flapper 220 and the second plate 222 illustrated in FIG. 4 is removed. The fastener 221 still resides in the slot 252, however, and secures the first plate 212 relative thereto. Of course, such a reconfiguration of the adjustable gain mechanism 300 would result in the low gain setting, indicated by the mark "L", and high gain setting, indicated by the mark "H" to be reversed from their positions illustrated in FIG. 4. The mark "M" signifies a medium gain setting. While such a configuration may not the most preferred embodiment, as loosening the nut 238 may result in a change in effective length of the attachment spring, it illustrates that various modifications of the present invention may be made without departing from the intended scope of the invention. It is noted, however, that any limitations associated with changing the length of the attachment spring may be effectively overcome by fixing the length of the attachment spring or readjusting the length each time the gain setting is changed.

Figure 6:
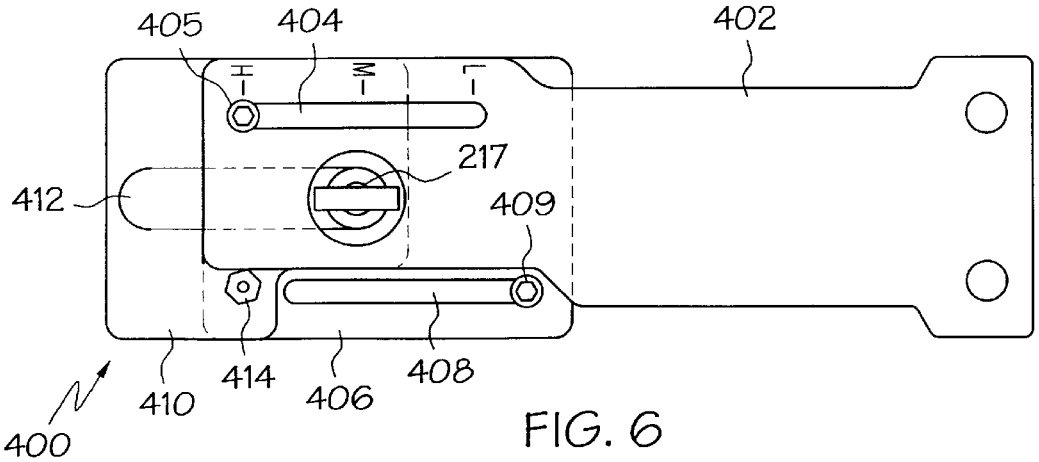
FIG. 6 is a top view of a third embodiment of a variably adjustable gain mechanism in accordance with the present invention.

FIG. 6 illustrates another preferred embodiment of an adjustable gain mechanism, generally indicated at 400, in which movement of the device from a high gain setting, indicated by the mark "H", to a low gain setting, indicated by the mark "L" is effected by translational rather than rotational movement. In this embodiment, the flapper 402 defines a first substantially linear slot 404 in which a first fastener 405 resides. A first plate 406 also includes a substantially linear slot 408 therein in which a second fastener 409 resides to secure the first plate 406 to the input capsule (see FIG. 3). A second plate 410 includes a third substantially linear slot 412 having a width sufficient to allow translational passage of the feedback spring holder 217. The attachment spring and associated nut 414 are secured between the first plate 406 and the second plate 410 and are moveable between a high gain setting and a low gain setting, as indicated along slot 404. Accordingly, when fasteners 405 and 409 are loosened, the first and second plates 406 and 410 can be translated relative to the flapper 402 until the gain is at the desired setting. The fasteners 405 and 409 can then be tightened. Thus, the gain can be set at a variety of settings without disassembling the positioner or any part thereof.

In general, the invention comprises a device for allowing adjustment of the gain of a pneumatic positioner through a range of gain settings without requiring disassembly of any part of the positioner. Moreover, those skilled in the art will appreciate the applicability of the present invention to other feedback control systems known in the art. Thus, it is to be understood that the above-described embodiments are only illustrative of the application of the principles of the present invention. Numerous modifications and alternatives may be devised by those skilled in the art, including combinations of the various embodiments and adaptation to other feedback control systems, without departing from the spirit and scope of the present invention. The appended claims are intended to cover such modifications, alternative arrangements, and combinations.

What is claimed is:

1. An apparatus for adjusting the gain of a pneumatic positioner, the pneumatic positioner being coupled to a pneumatic actuator having a stem, the pneumatic positioner having an input sensor arranged to sense the position of the stem and to receive an input signal indicative of a desired position of the stem and having a valve actuator arranged to supply air selectively to the pneumatic actuator, the apparatus comprising:

a coupling member extending between said input sensor and said valve actuator said coupling member being arranged to connect said input sensor to said valve actuator and for displacing said valve actuator in response to displacement of the input sensor, said coupling member being securable at a range of positions between a first position and a second position, wherein said coupling member further comprises a first attachment member associated with said input sensor and arranged to secure said coupling member to said input sensor and a second attachment member associated with said valve actuator and arranged to secure said coupling member to said valve actuator, wherein said valve actuator comprises a pilot valve capsule and a flapper extending from said pilot valve capsule over at least a portion of said input sensor, and wherein said flapper defines an arcuate slot therein and said second attachment member resides in said arcuate slot.

2. The apparatus of claim 1, wherein said first and second attachment members are arranged to allow rotational movement of said coupling member relative to said input sensor until said first attachment member is secured to said input sensor and said second attachment member is secured to said valve actuator.

3. The apparatus of claim 1, wherein said first and second attachment members allow translational movement of said coupling member relative to said input sensor until said first attachment member is secured to said input sensor and said second attachment member is secured to said valve actuator.

4. The apparatus of claim 1 wherein said input sensor comprises an input capsule including a first diaphragm, a second diaphragm, and a plate secured to said first diaphragm on a side facing said flapper, said first attachment member being securable to said diaphragm plate.

5. An apparatus for adjusting the gain of a pneumatic positioner, the pneumatic positioner having an input capsule and a pilot valve capsule, said apparatus comprising:

an elongate member having a first end and a second end, said first end being configured for attachment to the pilot valve capsule;

an attachment member having a distal end and a proximal end, said distal end being securable at a range of positions between a first position and a second position relative to said input capsule and said proximal end being securable proximate said second end of said elongate member; and a first plate associated with said input capsule, being movable relative thereto, and configured to be secured to said input capsule, said distal end of said attachment member secured to said first plate.

6. The apparatus of claim 5, further including a second plate associated with said elongate member, being movable relative thereto, and configured for being secured to said elongate member, said proximal end of said attachment member secured to said second plate.

7. The apparatus of claim 6, further including a second attachment structure associated with said second plate and said elongate member, said second attachment structure being arranged to secure said second plate to said elongate member.

8. The apparatus of claim 7, wherein said elongate member defines an arcuate slot therein, and wherein said second attachment structure resides in said arcuate slot.

9. The apparatus of claim 7, wherein said elongate member defines a substantially linear slot therein, and wherein said second attachment structure resides in said substantially linear slot.

10. The apparatus of claim 5, further including a first attachment structure associated with said first plate and said input capsule, said first attachment structure being arranged to secure said first plate to said input capsule.

11. The apparatus of claim 10, further including a second plate associated with said elongate member, wherein said input capsule further includes a third plate secured to a surface thereof and a rod extending from said third plate and through openings defined in said elongate member, said first plate and said second plate.

12. The apparatus of claim 10, wherein said first plate defines a first arcuate slot therein, and wherein said first attachment structure resides in said first arcuate slot.

13. The apparatus of claim 10, wherein said first plate defines a first substantially linear slot therein, and wherein said first attachment structure resides in said first substantially linear slot.

14. An adjustable gain mechanism for a pneumatic positioner, the pneumatic positioner having a flapper defining a first opening therein and an input capsule having a feedback spring holder extending therefrom and through said first opening, said adjustable gain mechanism comprising:

a first plate associated with the flapper and defining a second opening therein, the feedback spring holder extending through said second opening;

a second plate associated with the input capsule and defining a third opening therein, the feedback spring holder extending through said third opening;

an elongate member having a first end and a second end, the first end secured to the first plate and the second end secured to the second plate;

a first retaining member associated between the flapper and the first plate, said first retaining member being arranged to secure the flapper relative to the first plate; and a second retaining member associated between the input capsule and the second plate, said second retaining member being arranged to secure the input capsule relative to the second plate.

15. The apparatus of claim 14, wherein said first plate defines a first slot therein, and wherein said first retaining member resides in said first slot.

16. The apparatus of claim 14, wherein said flapper defines a second slot therein, and wherein said second retaining member resides in said second slot.

17. The apparatus of claim 14, wherein said second plate further includes a tab extending from an edge of said second plate, whereby movement of the tab moves said second plate relative to said input capsule.

18. An apparatus for adjusting the gain of a pneumatic positioner coupled to an actuator said apparatus comprising:

an input capsule responsive to a relative position of said actuator;

an adjustable gain mechanism coupled to said input capsule;

a flapper coupled to said input capsule via said adjustable gain mechanism, wherein said adjustable gain mechanism is arranged such that a degree of movement of said flapper relative to a degree of movement of said input capsule is controlled by said adjustable gain mechanism, and wherein said adjustable gain mechanism comprises an adjustable coupling arranged to couple said flapper to said input capsule at a range of positions between a high-gain position and a low-gain position; and a pilot valve capsule, wherein said pilot valve capsule is coupled to said flapper such that displacement of said pilot valve capsule is responsive to said degree of movement of said flapper, and wherein said pilot valve capsule is further coupled to said pneumatic positioner such that displacement of said pilot valve capsule results in a corresponding displacement of said pneumatic positioner.

19. An apparatus for adjusting the gain of a pneumatic positioner as claimed in claim 18 wherein said adjustable coupling comprises:

a slot; and an attachment member configured to move along said slot between said high-gain position and said low-gain position and to secure said flapper relative to said input capsule at a selected gain position between said high-gain position and said low-gain position.

20. An apparatus for adjusting the gain of a pneumatic positioner as claimed in claim 19 wherein said slot comprises an arcuate slot, said flapper defines said arcuate slot therein, and said attachment member resides in said arcuate slot.

* * * * *